United States Patent [19]

Bloch

[11] Patent Number: 4,824,104

[45] Date of Patent: Apr. 25, 1989

[54] ISOKINETIC EXERCISE METHOD AND APPARATUS, USING FRICTIONAL BRAKING

[76] Inventor: Ralph F. Bloch, 202 Rosemary Lane, Ancaster, Ontario, Canada, L9G 2K7

[21] Appl. No.: 72,149

[22] Filed: Jul. 10, 1987

[51] Int. Cl.[4] ..... A63B 21/22; A63B 21/24

[52] U.S. Cl. ..... 272/125; 272/129; 272/132; 272/DIG. 6; 188/134

[58] Field of Search ..... 272/125, 129, 131, 132, 272/73, DIG. 2, DIG. 6; 188/134, 162; 74/114, 127, 128

[56] References Cited

U.S. PATENT DOCUMENTS

| | | | |
|---|---|---|---|
| 3,433,332 | 3/1969 | Braun | 188/134 |
| 3,602,502 | 8/1971 | Hample | 272/DIG. 6 X |
| 3,874,659 | 4/1975 | Aharoni | 272/132 X |
| 3,896,672 | 7/1975 | Henson et al. | 272/125 X |
| 3,994,178 | 11/1976 | Hore | 188/134 X |
| 4,219,107 | 8/1980 | Ford | 188/134 |
| 4,402,503 | 9/1983 | Galbierz | 272/132 X |
| 4,408,613 | 10/1983 | Relyea | 272/DIG. 6 X |
| 4,678,184 | 7/1987 | Neiger et al. | 272/132 X |

*Primary Examiner*—Richard J. Apley
*Assistant Examiner*—David J. Bender
*Attorney, Agent, or Firm*—Omri M. Behr

[57] ABSTRACT

A concentric, isokinetic exercise apparatus providing accommodating resistance to the exercising user, while maintaining constant speed. The user exercises on a wheel, crank, lever or similar device. The power exerted by the user is applied directly or coupled by means of gears or chains to a rotating brake assembly comprising a braking rotor and a threaded hub. The threaded hub meshes with a threaded axle, turned by a reference motor at a selected speed. When hub and axle rotate at the same speed, the hub does not change its axial position. Any difference of rotational speed between axle and hub results in axial movement of the hub. Whichever of the two speeds is the larger determines the direction of axial movement. If the speed of the hub exceeds that of the axle, the hub with its attached brake rotor is moved towards the brake stator, thereby causing braking action. Conversely, if the hub speed is lower than that of the axle, the brakes disengage and eventually, a switch will interrupt the power to the reference motor.

11 Claims, 10 Drawing Sheets

Braking Torque
Motor Direction
-1.0
-.2
0
+.2
+1.0 mm
Linear Displacement

ISOKINETIC EXERCISE METHOD AND APPARATUS, USING FRICTIONAL BRAKING

BACKGROUND OF THE INVENTION

1. Field of the Invention

For many years, physical therapists have known instinctively that the best form of therapeutic exercise is movement of a muscle against a resisting force. This has been confirmed experimentally over the past 20 years. Because of the way muscles attach to bones on either side of a joint, and because of the biomechanical properties of muscle fibers, optimal forces change with changing joint angles. When applying manual therapy, it is relatively easy to vary the resisting force. However, tradiational mechanical exercise devices based on springs, weights or friction do not have the ability to adapt their resisting forces easily.

Research into muscle physiology has found exercise against constant resistance (isotonic) or without movement (isometric) less effective in increasing power and endurance of muscles than exercise where a constant velocity is maintained (isokinetic). This insight has found its way from the laboratory into treatment and training settings.

Because of its high cost, present isokinetic equipment is available only in few therapeutic settings and reserved mainly for rehabilitation after sport injuries. Current isokinetic exercise equipment is designed primarily for reciprocating movement and consequently not suitable for continuous exercise such as wheeling and cycling. A recent review of isokinetic exercise can be found in Osterning LR, *Isokinetic dynamometry: implications for muscle testing and rehabilitation.* Exerc. Sport Sci. Rev. 1986; 14: 45–80.

The present invention provides a simple exercise device, exhibiting isokinetic properties, which can be used in various forms of continuous and reciprocating exercise.

2. Discussion of Prior Art

Perrine (U.S. Pat. No. 3,465,592, Sept. 9, 1969) teaches the first truly isokinetic exercise method and apparatus, giving reference to his earlier inventions. He describes two almost separate inventions. His first embodiment uses the principle of the locked worm gear to absorb the power from the exercising person. The apparatus uses locked worm gears and overrunning clutches. The user moves the gear through an interfacing means. The speed of operation is determined by a motor turning the worm. The whole power, arising both from exercise and the motor, is absorbed in the worm and gear, causing high temperatures and wear. If the worm gear does exhibit significantly negative efficiency, the power required by the reference motor increases, the harder the user exercises. Because of this, the second embodiment, using hydraulic cylinders, is also used commercially. In this embodiment only reciprocating operation is possible over limited angles of operation.

Wilson (U.S. Pat. No. 3,902,480, Sept. 2, 1975). A feedback controlled system utilizing electronic and electromechanical devices as controlled exercising loads for use in isotonic or isokinetic exercising therapy, the equipment affording a wide variety of operating modes.

Flavell (U.S. Pat. No. 3,869,121, Mar. 4, 1975). A proportional resistance exercise servo device. User interfacing means is connected to a drive shaft so that the user applies force to said drive shaft and vice versa. The device applies braking force to the drive shaft as it is rotated in a first direction by user-exerted force on the interfacing means, in a braking mode; and it applies power to drive the drive shaft in a second direction and thereby exerts force on the interfacing means, in a power mode. Direction reversal means automatically stops the braking at a first limit and thereafter applies power thereto, and automatically stops the power at a second limit and thereafter begins braking it. Both the braking and powering are programmed, but feedback alters the program in accordance with the user's performance. Acceleration and deceleration are controlled. Various performance parameters are displayed or recorded.

Proctor (U.S. Pat. No. 4,007,927, Feb. 15, 1977). Is typical for traditional exercise cycles: A stationary frame on a supporting surface carries a handlebar and seat to accommodate a person wishing to exercise. A flywheel above the supporting surface is journalled on the frame for rotation by a pair of pedals; and an adjustment knob on the frame enables the rider to control the amount of braking resistance exerted on the flywheel by a pair of brake shoes.

Flavell (U.S. Pat. No. 4,082,267, Apr. 4, 1978). A proportioned resistance exercising apparatus capable of exercising two limbs synchronously or separately with a single resistance mechanism. Two limb-engageable drive input devices are connected through one-way clutches to a single rotary shaft, which is, in turn, drivingly connected to the proportioned isokinetic resistance-producing mechanism.

Snellen (Snellen JW; Chang KS. Calorimeter ergometer for concentric and eccentric work. Med. Biol. Eng Comput 1981 May;19(3):356–8) has published a concentric/eccentric ergometer, using a 3HP universal motor driving the input of a differential gear of a small import car. Both outputs drive dynamometers, one of them connected to the exercise source.

Fisher (U.S. Pat. No. 4,363,480, Dec. 14, 1982) teaches the use of centrifugally responsive friction brakes in an isokinetic treadmill. Because of the finite gain of a centrifugal regulator, isokinetic operation is achieved only in approximation.

Ruggles (U.S. Pat. No. 4,374,588, Feb. 22, 1983) describes a small frictional exercise device, said to be isokinetic, though speed is not directly controlled; rather, the frictional force is a function of the applied force, by means of a little ball bearings, running in arcuate raceways. It is not truly isokinetic and has limited application.

Mattox (U.S. Pat. No. 4,385,760, May 31, 1983). A slide is confined for travel along a guide having a surface which can be interengaged by one or more friction pads on the slide. An operating lever rigid to the slide and projecting outwardly therefrom may be grasped at its outer end for the purpose of operating the slide, and because the slide is loosely confined on the guide, the user-applied force on the lever rocks the slide in a direction to press the friction component or components tightly against the cooperating surface of the guide to produce frictional resistance as the slide travels along the guide. The pads may be adjustably positioned in any one of a number of locations for achieving variation in resistance generated by the exerciser, and the lever is itself extensible for adjustment of the moment arm between the end of the lever and the surface of the surface engaged by the friction pads. A variety of embodiments are disclosed including a rectilinear form and a curvilinear form.

McCartney (McCartney N, Heigenhauser GJF, Sargeant A J, Jone NL. A constant velocity cycle ergometer for the study of dynamic muscle function. J Appl. Physiol. Respir. Environ Exerc. Physiol 1983; 55(11):212–7) describes a motor driven cycle ergometer. Here the whole power is absorbed in a 3HP DC motor with regenerative control, which makes the apparatus very expensive.

Marczewski (U.S. Pat. No. 4,466,612, Aug. 21, 1984). A variable resistance exercising device is described for executing isometric, isotonic and isokinetic exercises. The device includes a unitary, open-ended mandrel or bar which is shaped to define at least one shaft which is adapted to receive several turns of rope thereon, an open support loop for the rope situated near one end of the shaft, and an open guide loop at the other end of the shaft for holding the rope in proper engagement with the shaft. By virtue of the mandrel's open-ended construction, the rope may be easily engaged or disengaged from the device, and the resistance provided by the device may be changed quickly.

Boettcher (U.S. Pat. No. 4,565,368, Jan. 21, 1986). An isokinetic exercise and monitoring machine for use in exercising and evaluating an individual's back muscles. A preferred embodiment comprises a restraining means for sandwiching the lower body half that is adjustably connected to a support frame a restraining means for sandwiching the upper body half, including means for pivoting the upper body restraining means about the lower body restraining means in response to the individual's movement generated by extension and flexion of his back muscles' a spring-loaded stop to prevent overtravel and excessive deceleration of the second restraining means at the end of its rotational movement, means for vertically adjusting a platform upon which the individual stands so that the restraining means and engage his body appropriately; and wheels and attached to a support frame to provide portability of the machine. The lever arm of a dynamometer attaches to a central point of the upper body restraining means to prevent twisting of the lever arm and problems caused thereby.

Krukowski (U.S. Pat. No. 4,628,910, Dec. 16, 1986). A muscle exercise and rehabilitation apparatus comprises a movable arm against which a force can be applied; a servo motor mechanically coupled to the arm through a gear reducer; a sensing device for sensing the force applied to the arm and for producing a load signal corresponding thereto; a tachometer for producing a velocity signal corresponding to the velocity of the arm; a closed loop velocity servo feedback circuit for controlling the motor in response to a control signal and the velocity signal so that the arm has a constant resistive torque applied thereto and/or has its velocity regulated, regardless of the force applied to the arm, the feedback circuit including an amplifier for amplifying the load signal to produce the control signal, a torque control circuit and a speed clamp circuit for modifying the control signal of the amplifier to produce a modified control signal, depending on the mode of operation; a switch for switching in at least one of the torque control circuit, the speed clamp circuit, an eccentric circuit which controls eccentric operation and an oscillator circuit, and a PWM amplifier for producing an error signal in response to the modified control signal and the velocity signal to control the motor to regulate the velocity of the arm and/or apply a constant resistive torque to the arm, for both extension and flexion, as well as concentric and eccentric operation, regardless of the force applied to the arm.

McArthur (U.S. Pat. No. 4,637,607, Jan 20, 1987). A drive unit for providing kinetic frictional resistance to an exercising apparatus which includes a sub-frame with a driving and driven element coupled to the sub-frame a motor coupled to the driving element for rotatably driving the latter. The driving and driven elements are coupled such that the driving and driven elements slip relative to one another. An adjustment is provided for adjusting the kinetic friction force between the driving and driven elements, while a stop is mounted on the sub-frame for blocking the driven element from movement beyond a start position. In operation the driving element is continuously driven by the motor throughout an exercise so that only kinetic friction has to be overcome by a user.

Bloemendaal (U.S. Pat. No. 4,645,199, Feb. 24, 1987). An exercise device includes a rotor which rotates upon action of an operator. Resistance to rotation of the rotor is provided by fluid trapped between the rotor and a non-rotating portion of the device. A friction relief mechanism provides periodic variation in the amount of resistance to rotation as the rotor is rotated. A fluid level adjustment mechanism permits control of the amount of fluid positioned between the rotor and the non-rotating portion of the device. As the amount of fluid between the rotor and the non-rotating portions of the assembly is increased, the total amount of energy required to complete a single revolution of the rotor is generally increased. In a preferred embodiment, the device is an exercise cycle operated by pedaling. The friction relief mechanism operates so that when the pedaler has pedals positioned at vertical extremes, resistance to pedaling is least; and when the pedals are positioned substantially halfway between the vertical extremes, resistance to pedaling is at a maximum. This periodic variation in the a mount of energy required for rotation, caused by the friction relief mechanism, generally matches a profile of a normal bicycle pedaler's muscle capabilities and output.

SUMMARY OF THE INVENTION

This invention relates generally to exercise apparatus and, more particularly, to exercise apparatus compelling isokinetic type exercise in a concentric direction against proportioned resistance, employing automatic, mechanical control of braking.

Exercise, applied through an interfacing means, is coupled to an exercise member. The exercise member is part of a mechanical comparator, comparing the speed of exercise with that of an electric reference motor. Any difference between the two rotational speeds causes a linear movement. If the liner movement is in the direction corresponding to excess exercise speed, it causes an increase in the engagement of frictional brakes. Conversely, if the linear movement is in the direction corresponding a deficit in the exercise speed compared to the reference speed, it will activate an electrical switch to interrupt the current to the reference motor.

It is therefore the primary object of the present invention to provide an isokinetic exercise apparatus having accommodating, active resistance while accurately maintaining a preselected speed.

A second object of this invention is to achieve true isokinetic operation more simply and economically than in prior art.

It is still another object of this invention to allow both reciprocating and continuous exercise.

It is also an object of this invention to provide an exercise means to a variety of users, ranging from the disabled patient to the able bodied athlete.

It is an additional object of this invention to provide a source of isokinetic resistance for a variety of different exercises, including wheeling, cycling, single joint exercise and functional task simulation.

It is a further object of this invention to allow measurement, display and recording of exercise torque and expended power.

In addition, it is an object of this invention to provide said isokinetic exercises safely, without the usual hazards associated with an actively powered, eccentric exercise apparatus.

Another object of this invention is to provide an isokinetic exercise apparatus, allowing for easy user setup, without the need for accurate joint axis alignment.

It is still another object of this invention to control the accommodating resistance by comparing the exercise speed with a preselected reference speed and operating a frictional brake according to the intergrated difference between the actual and reference speed.

Further objects and advantages of my invention will become apparent from a consideration of the drawings and ensuing description thereof.

DETAILED DESCRIPTION OF THE PREFERRED EMBODIMENTS

As required, detailed embodiments of the present invention are disclosed herein; however, it is to be understood that the disclosed embodiments are merely exemplary of the invention which may be embodied in various forms. Therefore, specific structural, functional and schematic details disclosed herein are not to be interpreted as limiting, but merely as a basis for the claims and as a representative basis of teaching one skilled in the art to variously employ the present invention in virtually any appropriate detailed structure.

Figure 1:
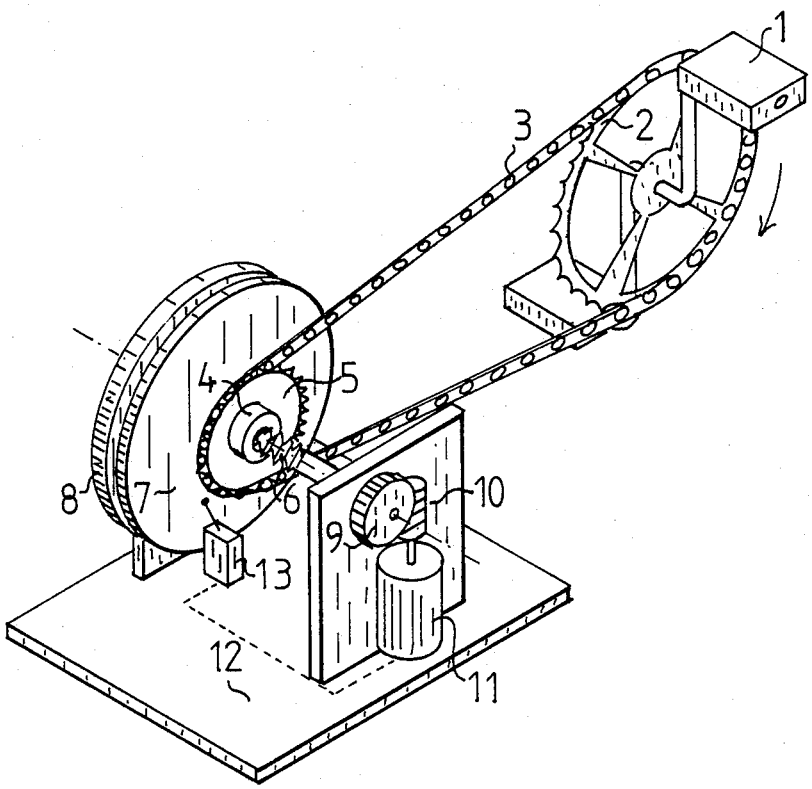
FIG. 1 is an isometric view of a preferred embodiment of an exercise device according to the present invention.
Figure 2:
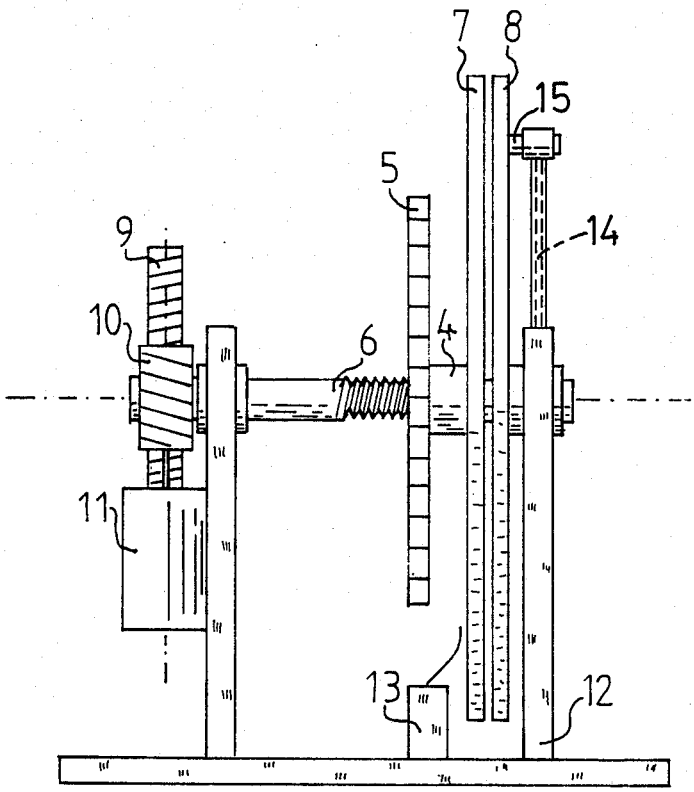
FIG. 2 is an elevational rear view of the same preferred embodiment.

Referring now to the drawings wherein like reference numerals denote like elements throughout the several different views of an embodiment, FIGS. 1 and 2 show an embodiment of the invention for use as isokinetic cycle ergometer. Foot pedals (1) are connected to a sprocket gear (2), in turn meshing with a chain (3). These elements being familiar to one skilled in the art are shown only schematically. The chain meshes in turn with a sprocket pinion (5). The sprocket pinion is rotatingly connected to an exercise member (4) and a brake rotor (7). The exercise member is a hollow tube with an internal, right handed, helical thread, which in turn meshes with the external, right handed, helical thread on a co-axial axle (6). The axle is journalled on two sides of the mounting frame (12). One end of the axle extends beyond the journal and is keyed to a gear (9). The gear meshes with a worm (10), on the shaft of a small reference motor (11). A brake stator (8), coaxial with the axle (6), faces the brake rotor (7) engageably. Brake stator and rotor have matching frictional surfaces on the two corresponding faces. A small, normally closed limit switch (13), electrically interposed between the reference motor and an electrical power source, is activated by the brake rotor surface facing away from the brake stator. A restraining member (14) is vertically cantilevered on the top of the mounting frame, adjacent to the brake stator. The upper end of the restraining member is eye shaped and surrounds a fixed bolt (15), extending horizontally from the brake stator. Two strain gauges are mounted on the restraining member in a manner familiar to one skilled in the art.

In operation, any exercise-induced rotation of the foot pedals (1) is transmitted to the exercise member (4) by means of the sprocket and chain mechanism (2,3 and 5). The reference motor (11) is initially halted with limit switch (13) activated by the brake rotor (7), thereby interrupting the electrical power to the reference motor. Clockwise rotation of sprocket gear (5), exercise member (4) and brake rotor (7) assembly on the immobile axle (6) causes linear, axial movement of the said assembly towards the brake stator. After a short axial movement of the brake rotor (7), the limit switch (13) is released, thereby powering the reference motor (11). The speed of the reference motor is controlled by methods known to one skilled in the art. The reference motor (11) turns the worm (10), which in conjunction with the gear (9) turns the axle (6) at a fixed speed. If the rotational speed of the exercise member (4) corresponds to that of the axle (6), no net axial, linear movement occurs. If the rotational speed of the exercise member (4) exceeds that of the axle (6), the brake rotor (7) is progressively pressed against the brake stator (8), thereby increasing braking torque, until it is equal to the transmitted torque generated by the user. If the rotational speed of the exercise member (4) lags behind that of the axle (6), the brake rotor (7) progressively disengages from the brake stator (8) and ultimately may activate the limit switch (13), thereby interrupting the electrical power to the motor (11). Braking torque exerted on the brake stator is resisted by the restraining member (14). The resulting strain is measured by the strain gauges. This allows estimation of braking torque and thereby of exerted power.

Figure 3:
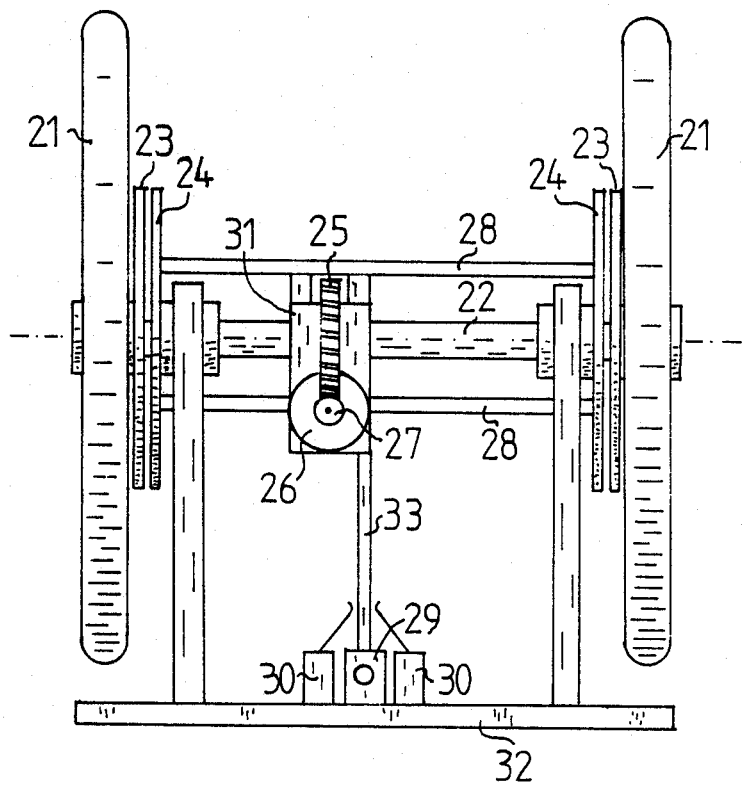
FIG. 3 is a frontal elevational view of another preferred embodiment of an exercise device.
Figure 4:
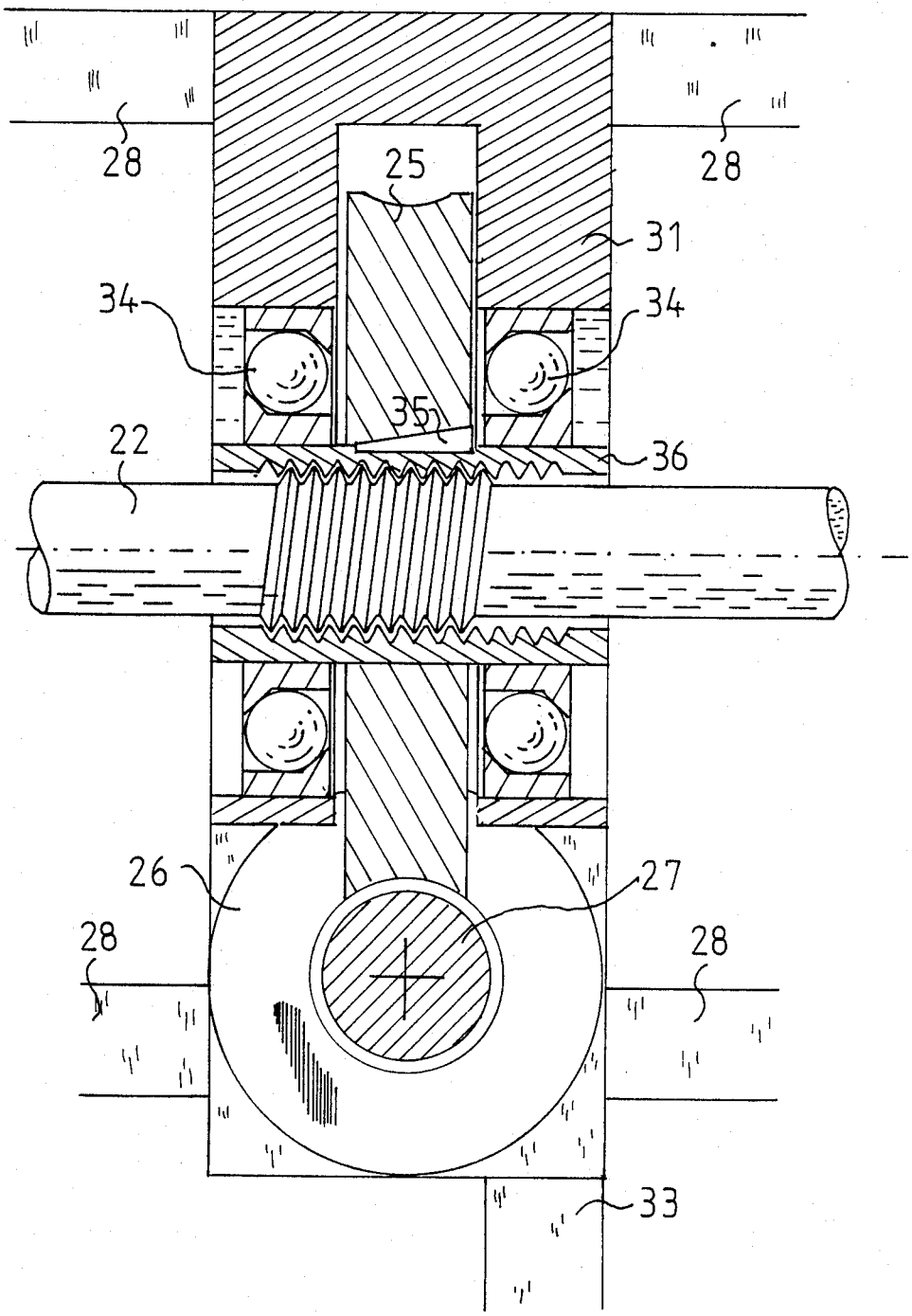
FIG. 4 is an enlarged, frontal, fragmentary elevation of part of the exercise device shown in FIG. 3, having portions cut out to show detail.

FIGS. 3 and 4 show another embodiment, adapted for use as an isokinetic wheelchair ergometer. An axle

(22) is journalled on two sides of a mounting frame (32). The axle extends beyond the journals. Wheelchair wheels (21) are rotatingly mounted on the axle. Co-axially coupled to the wheels (21) are the brake rotors (23). The central part of the axle (22) is helically, right-handedly threaded. A hollow, tubular member (36) is internally, right-handedly, helically threaded, meshing with the thread of the axle. The hollow tubular member (36) is keyed (35) with a gear (25) and journalled on either side by a radial thrust bearing (34) in a carriage (31). The gear (25) meshes with a worm (27), driven by the shaft of a reference motor (26), mounted on the carriage (31). The speed of the reference motor (26) is controlled in a manner known to one skilled in the art. Horizontally extending to either side from the carriage (31) are two parallel bars (28). Two brake stators (24) are rigidly mounted on the bars (28), engageably facing the brake rotors (23). Brake stators and rotors have matching frictional surfaces on corresponding faces. Cantilevered on and extending vertically from the carriage (31) is a torque beam (33), instrumented with strain gauges in a manner known to one skilled in the art. The lower end of the torque beam (33) engages in a restraining channel (29), running parallel to the axle (22). On either end of the the restraining channel (29) is a normally open limit switch (30), controlling electrical power to and direction of the reference motor (26).

In operation, the reference motor (26) is initially at rest, with both limit switches (30) open. The user starts turning the wheels (21) in one direction. Since the reference motor (26) does not turn, the hollow tubular member (36) is stationary as well. The axle (22), connected to the wheels (21) turns and moves the carriage (31) in an axial direction the torque beam (33) prevents rotation of the carriage (31), being stressed by the total torque applied to the wheels (21). As the torque beam (33) moves axially, it operates one of the two limit switches, causing rotation of the reference motor (26) in a direction for the hollow tubular member to follow the rotation of the axle. If the axle turns faster than the hollow tubular member, the carriage (31), with parallel bars (28) and brake stator (24) moves towards one of the brake rotors (23), thereby progressively increasing the braking torque, until the braking torque equals the torque the user applies to the wheels (21). If the user slows down, the carriage (31) moves in the opposite direction, progressively disengaging the brake stator (24) from the brake rotor (23) and eventually the torque beam (33) releases the respective limit switch (30), stopping the reference motor (26). The torque exerted by the user is transmitted to the torque beam (33) and measured as strain by the strain gauges.

Figure 5:
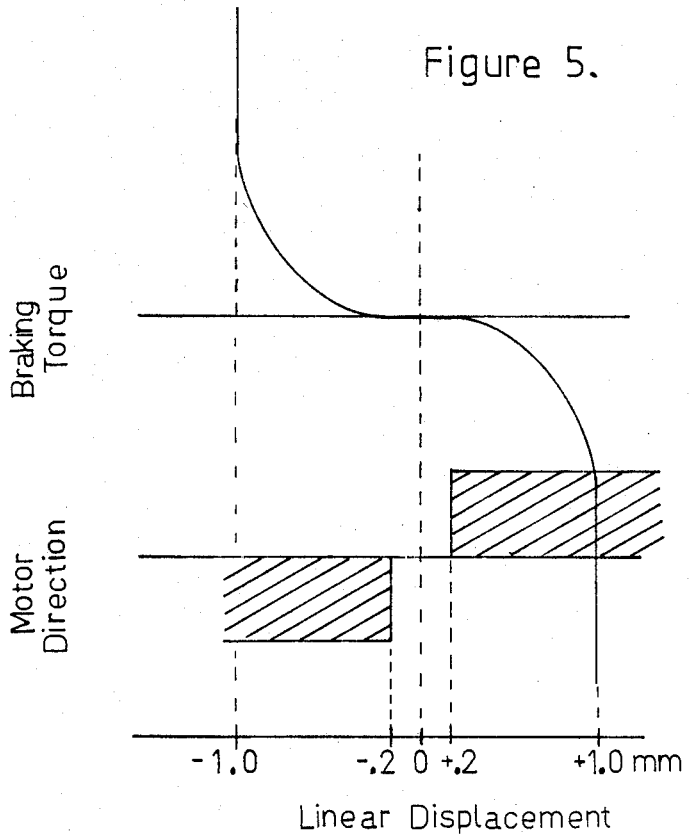
FIG. 5 is a schematic diagram, showing the relationship between liner movement, braking torque and rotational direction of the reference motor in all the embodiments.

FIG. 5 schematically illustrates the relationship between the liner displacement of the carriage (31) and the direction of the motor and braking torque. When the carriage moves from the neutral position by a threshold distance, the motor starts turning in the appropriate direction. If the carriage moves further, the braking toque rapidly increases, asymptotically going to infinity as brake rotor and stator make total contact.

Figure 6:
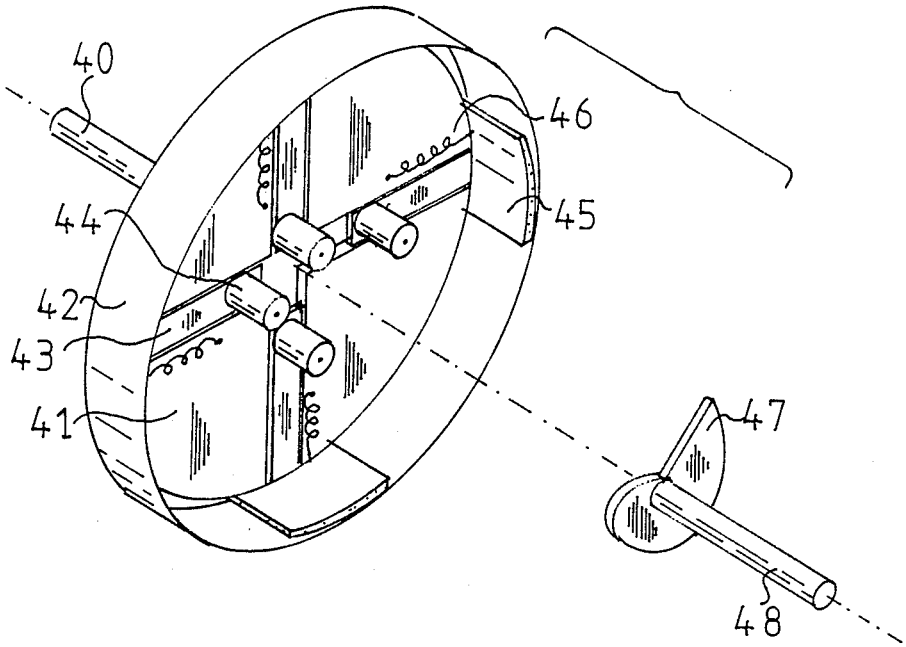
FIG. 6 is a frontal isometric view of an alternate means for comparing the rotational speed between exercise movement and reference motor.
Figure 7:
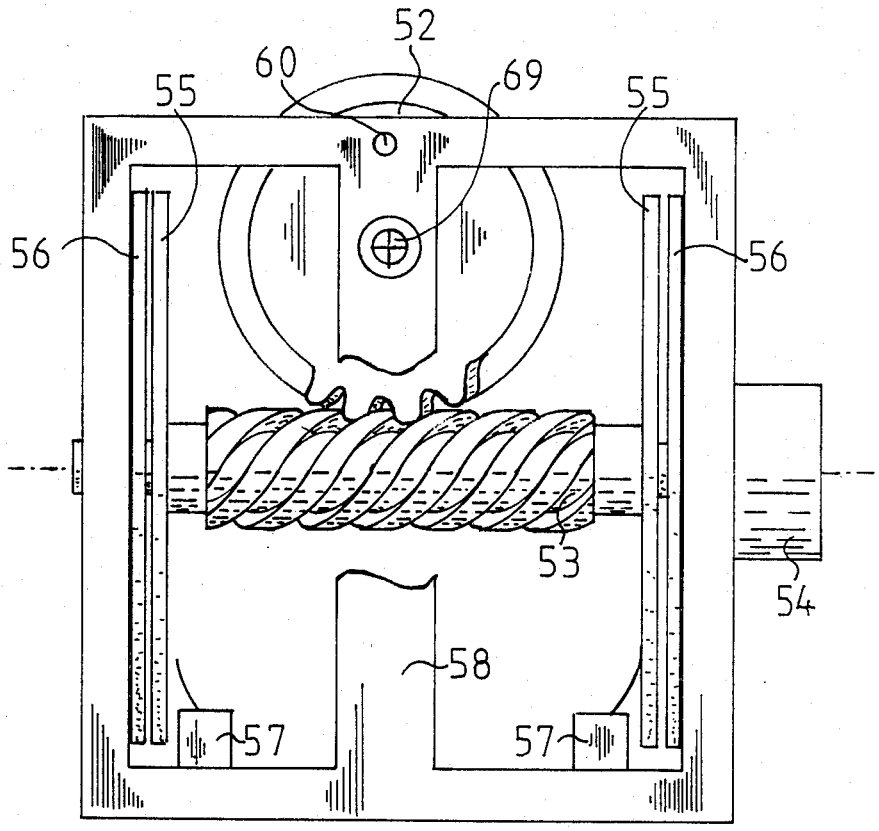
FIG. 7 is a frontal, fragmentary, elevational view of yet another preferred embodiment of an exercise device according to the present invention, having portions broken away to show detail.
Figure 8:
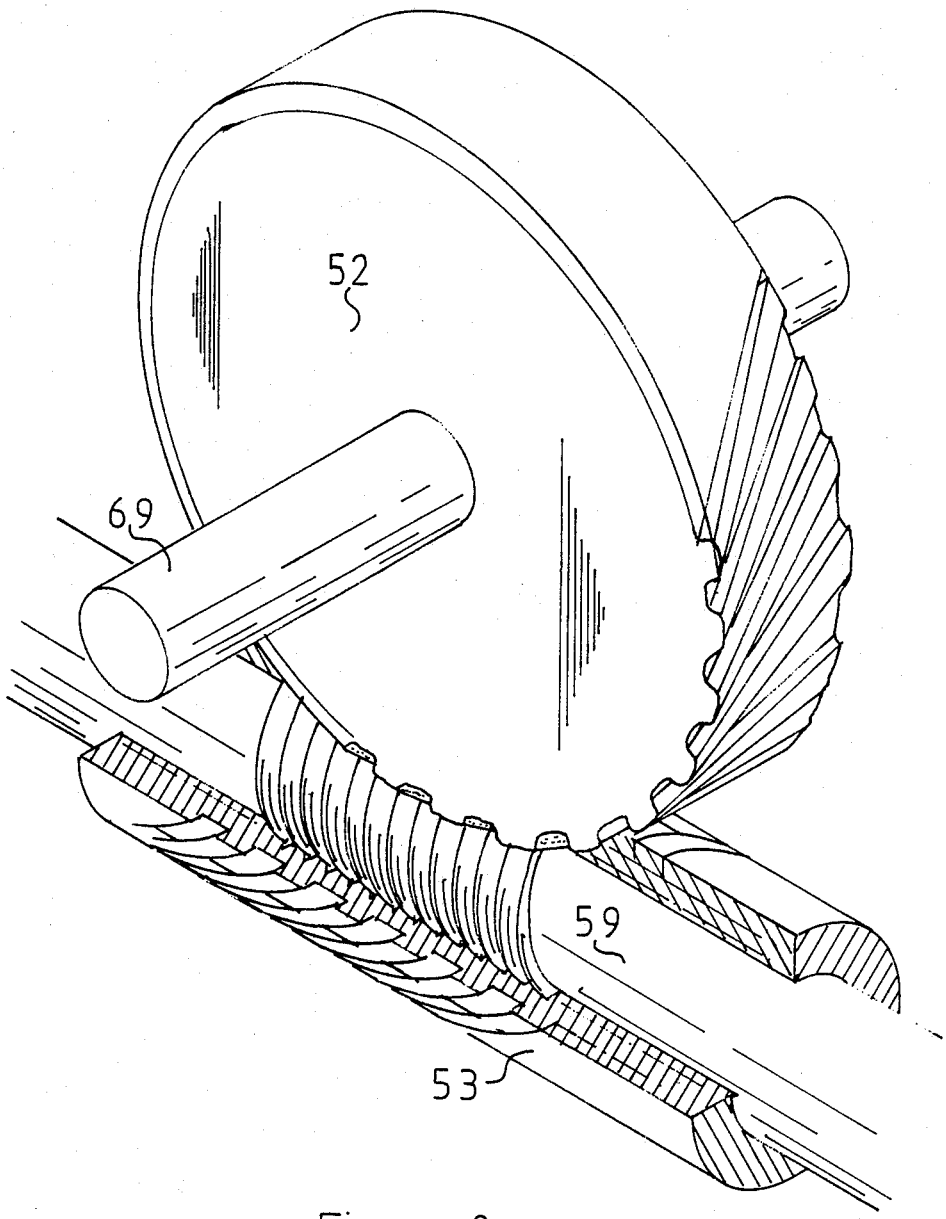
FIG. 8 is an enlarged fragmentary isometric view of part of the exercise device as shown in FIG. 7, having portions cut out to show detail.
Figure 9:
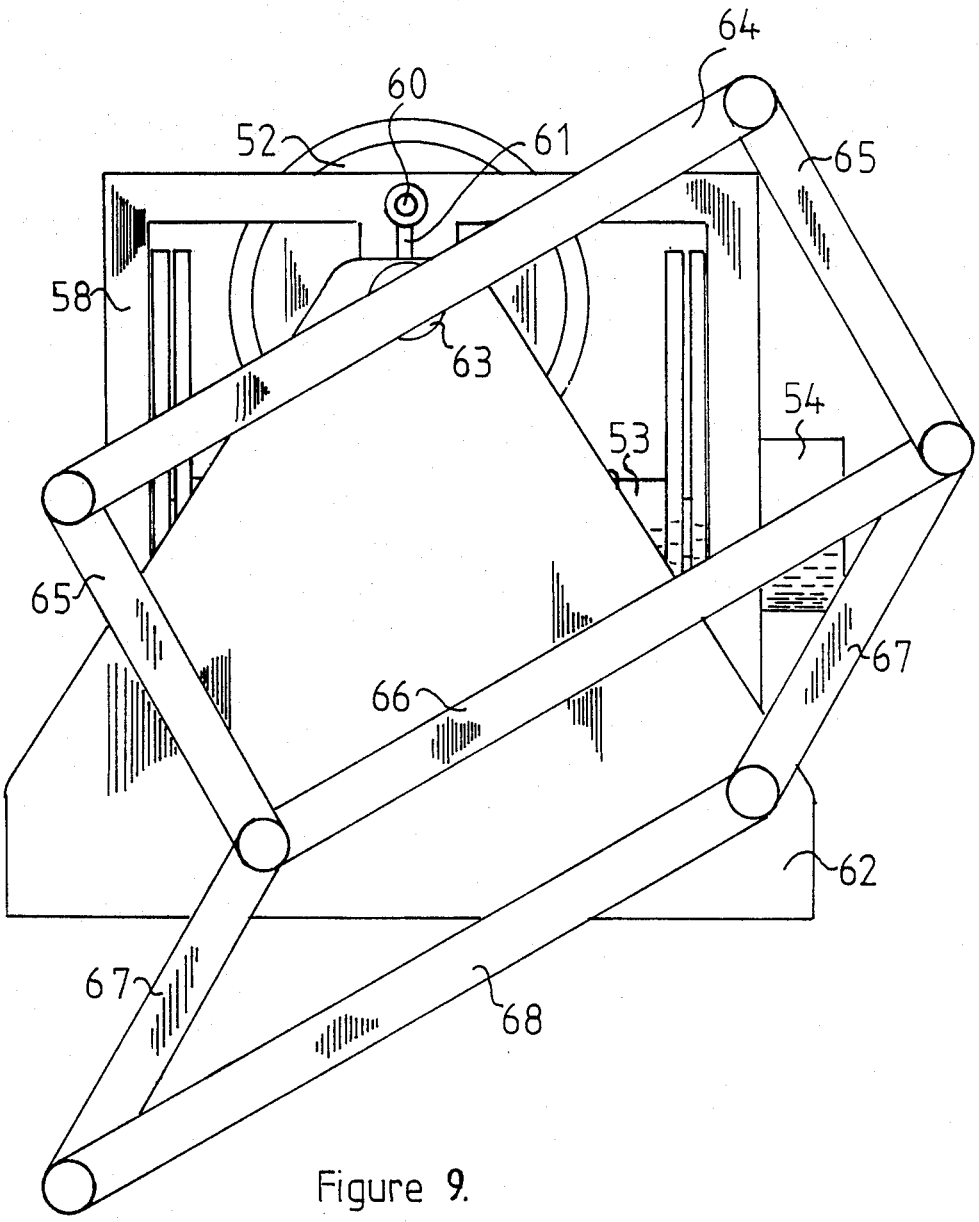
FIG. 9 is a complete frontal, elevational view of the device shown in FIG. 7 with added user interface.
Figure 10:
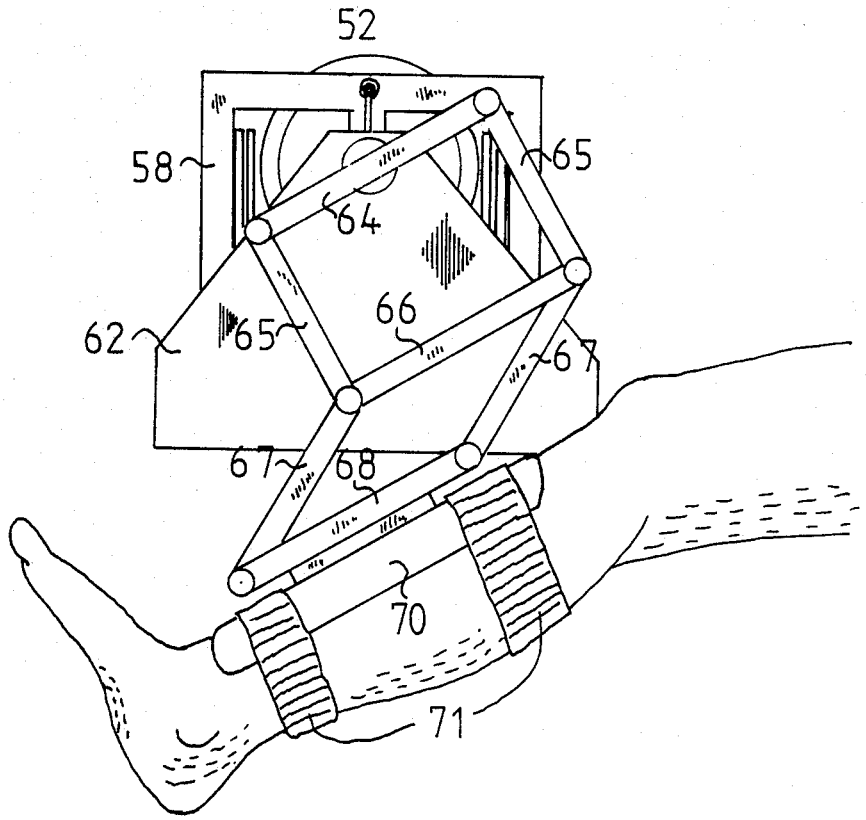
FIG. 10 is a frontal, elevational view of the device shown in FIG. 9 shown in actual use.

FIG. 6 illustrates an alternate method for translating a difference in speed between the exercise member and the reference motor into linear movement to operate brakes. The reference motor (not shown) is coupled to the reference shaft (48) to which a spiral cam (47) is rotatingly connected. Exercise is applied by means of a user interface (not shown) to the exercise shaft (40) to which the exercise member (41) is rotatingly connected. Four sliders (43) run in radial 1 groves on the exercise member (41). On the central end of each of the four sliders (43) is a cylindrical roller (44), meshing with the spiral cam (47). The outer end of each slider (43) carries a brake pad (45), engageably facing the stationary brake drum (42). The rollers (44) are held against the spiral cam (47) by means of restoring springs (46). The distance between roller (44) and brake pad (45) differs for each slider according to the spiral on the cam (47).

In operation, both the exercise member (41) and the spiral cam (47) rotate in a counter clockwise direction when seen from the front. When exercise and reference speed are identical, the radial position of the rollers (44), sliders (43) and brake pads (45) remains constant. If the exercise speed exceeds that of the reference motor, the rollers (44) move counter clockwise on the spiral cam (47), forcing an outward movement of roller (44), slider (43) and brake pad (45) and thereby increasing the braking torque on the exercise member.

Yet another embodiment of this invention is illustrated in FIGS. 7, 8, 9 and 10. A limb of the exercising person is strapped, by means of flexible straps (71) to a molded cradle (70), rigidly connected to the terminal bar (68) of a dual four-bar linkage system (64, 65, 66, 67, 68). The primary bar (64) of the linkage system, at its midpoint, is rotatingly mounted on the exercise shaft (69). The exercise shaft (69) is journalled in two sides of the mounting frame (58). The mounting frame (58) is also gimbaled (63), coaxially with the exercise shaft (69) in the support frame (62). The exercise shaft (69) is keyed to gear (52) which meshes with the external, left handed thread of the hollow tubular worm (53). Internally, the hollow tubular worm has a right handed thread which 1 meshes with the external right handed threaded of the threaded axle (59). The threaded axle (59) is coupled to the shaft of the reference motor (54). On either side, the hollow tubular worm (53) is coupled to a brake rotor (55). Each of the two brake rotors (55) engageably faces a brake stator (56). The mounting frame (58) carries a restraining bolt (60). A torque beam (61) is cantilevered on the support frame (62), extending radially outward from the exercise shaft (69) and is pivotally connected to the restraining bolt (60). The torque beam (62) is instrumented with strain gauges in a manner known to one skilled in the art. Each brake rotor (55) is juxtaposed to a limit switch (57) which controls the direction of operation of the reference motor (54).

In operation, the exercising person moves his/her limb to change the joint angle, thereby exerting a torque on the cradle (70). The torque is transmitted to the exercise shaft (69) by means of the dual four bar linkage (64, 65, 66, 67, 68), allowing spatial translation with two degrees of freedom. We consider the apparatus initially at rest. The torque on exercise shaft (69) causes rotation of the latter and of the gear (52). Gear (52) and hollow tubular worm (53) are meshed to cause rotation of the hollow tubular worm at a higher speed of rotation than the gear. With reference motor (54) and threaded axle (59) at rest, rotation of the hollow tubular worm (53) causes linear, axial movement of the worm (53) and brake rotors (55). One of the two limiting switches (57) is released, thus energizing the reference motor (54) in the same direction of rotation as the worm (53). As long as worm (53) and axle (59) rotate at the same speed, no net axial movement of worm (53) and brake rotors (55) occurs. If the rotational speed of the worm (53) exceeds that of the axle (59), worm (53) and brake rotors (55)

move axially, thereby increasingly engaging one of the brake rotor/stator pairs (55/56), causing a braking torque on the worm (53) which is transmitted back to the exercise shaft (69) and ultimately to the limb of the exercising person, by means of the dual four bar linkage system (64, 65, 66, 67, 69) and the cradle (70). Since the torque acts on the exercise shaft, it is also experienced by the mounting frame (58), which would rotate at the gimbals (63), were it not restrained by the torque beam (61) and restraining bolt (60). The exercise torque thus causes a straining the torque beam (61) which is measured by the attached strain gauges.

I claim:

1. Muscular exercise apparatus, for maintaining a maximum speed independent of an exercise force applied by an exercising person, comprising:

exercising means for engagement by said exercising person to apply said exercise force;

a mounting frame;

a brake stator, fixedly supported by the mounting frame;

a brake rotor facing, juxtaposed and engageable with the brake stator;

telescoping means having a pair of nested coaxial members, said coaxial members being threadably engaged to expand and contract axially in response to relative coaxial rotation of said coaxial members, said telescoping means being coupled between said mounting frame and said brake rotor for reciprocating said brake rotor with respect to said brake stator in response to relative coaxial rotation of said members;

a reference motor coupled to one of said pair of coaxial members, the other one of said coaxial members being coupled to said exercising means to be rotated thereby;

whereby an effective difference between the rotational speeds produced at the telescoping means by the reference motor and the exercising means is translated into linear, axial motion of the brake rotor, controlling brake pressure.

2. The apparatus in accordance with claim 1 further comprising:

motor energizing means including electric limit switch means for switching electric power to the reference motor, said switch means being mechanically coupled to said brake rotor to close and open an electrical circuit with said reference motor when the brake rotor moves towards and away from, respectively, the brake stator.

3. The apparatus in accordance with claim 1, further including:

gauge means mounted about said brake stator for measuring the braking torque transmitted by the brake rotor to the brake stator.

4. Muscular exercise apparatus, for maintaining a maximum speed independent of an exercise torque applied by an exercising person, comprising:

a. a rotating exercise member to which said exercise torque is applied to the apparatus;

b. an electric reference motor;

c. a mounting frame;

d. frictional braking means coupled between the exercise member and the mounting frame, for resisting said exercise torque;

e. electrical switching means serially connected with the reference motor;

f. mechanical speed comparator means coupled to said frictional braking means, said reference motor and said exercise member for translating a difference in the rotational speed of the reference motor and the exercise member into liner motion in said frictional braking means to control the frictional braking means, by increasing the braking torque of the frictional braking means as the speed of the exercise member exceeds the speed of said reference motor; and g. switch control means coupled to said electrical switching means and responsive to said linear motion of said comparator means for controlling the switching means, to interrupt power to the reference motor if the speed of the motor remains greater than the speed of the exercise member.

5. Apparatus as set forth in claim 4, wherein the frictional braking means comprises:

a. a brake stator lined with frictional material;

b. restraining means for preventing the brake stator from rotating relative to the mounting frame; and c. a brake rotor coupled

6. Apparatus as set forth in claim 5, wherein said mechanical speed comparator is operable in response to rotational speed of the exercise member being greater and less than the speed of the reference motor to cause the brake rotor to engage the brake stator variably, and increase and decrease, respectively, the braking torque on said brake rotor.

7. Apparatus as set forth in claim 5, wherein said switch control means comprises an electrical limit switch having an actuator facing a surface of the brake rotor, whereby a movement of the brake rotor towards the limit switch operates said limit switch.

8. Apparatus in accordance with claim 5, further including a strain gauge mounted on the frictional braking means for measuring the braking torque, transmitted by the brake rotor to the brake stator. with the exercise member, and facing and engageable with the brake stator; whereby relative closing motion between the brake rotor and the brake stator alters contacting pressure between them and thereby changes the braking torque.

9. Apparatus as set forth in claim 4, wherein the electrical switching means comprises:

a mechanically actuated limit switch.

10. Apparatus as set forth in claim 4, wherein the mechanical speed comparator means comprises:

a. a helically, externally threaded axle, coupled to and driven by the reference motor; and b. a helically, internally threaded hub, coupled to and driven by the exercise member and meshing with the threaded axle; whereby a difference in rotational speed between the threaded hub and the threaded axle causes liner, axial motion of said threaded hub on said threaded axle.

11. Apparatus as set forth in claim 4, wherein the exercise member comprises a chain and sprocket.

* * * * *

UNITED STATES PATENT AND TRADEMARK OFFICE

CERTIFICATE OF CORRECTION

PATENT NO. : 4,824,104

DATED 4/25/89

INVENTOR(S) : Ralph F. Bloch

It is certified that error appears in the above-identified patent and that said Letters Patent is hereby corrected as shown below:

Column 1, line 16, delete "tradiational", insert --traditional--.

Column 4, line 55, delete "liner" insert --linear--.
Column 5, line 42, delete "liner" insert --linear--.
Column 7, line 54, delete "liner" insert --linear--.
Column 10, line 10, delete "liner" insert --linear--.
Column 10, line 60, delete "liner" insert --linear--.

Column 7, line 59, delete "toque" insert --torque--.

Column 9, line 11 delete "straining" insert --strain in--.

Column 10, line 27, after "coupled" insert --with the exercise member, and facing and engageable with the brake stator; whereby relative closing motion between the brake rotor and the brake stator alters contacting pressure between them and thereby changes the braking torque--.

Signed and Sealed this

Twenty-first Day of November, 1989

*Attest:*

JEFFREY M. SAMUELS

*Attesting Officer* *Acting Commissioner of Patents and Trademarks*